US007493069B2

(12) United States Patent
Akedo

(10) Patent No.: US 7,493,069 B2
(45) Date of Patent: Feb. 17, 2009

(54) DEVELOPING APPARATUS AND IMAGE FORMING APPARATUS PROVIDED WITH THE SAME

(75) Inventor: Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 11/638,470

(22) Filed: Dec. 14, 2006

(65) Prior Publication Data

US 2007/0140744 A1 Jun. 21, 2007

(30) Foreign Application Priority Data

Dec. 15, 2005 (JP) ..... P2005-362381

(51) Int. Cl.
*G03G 15/08* (2006.01)

(52) U.S. Cl. ..... 399/255; 399/254

(58) Field of Classification Search ..... 399/254, 399/255, 256

See application file for complete search history.

(56) References Cited

U.S. PATENT DOCUMENTS

| | | | | |
|---|---|---|---|---|
| 5,436,703 | A * | 7/1995 | DeYoung et al. | 399/256 |
| 5,655,193 | A * | 8/1997 | Fujishiro et al. | 399/256 |
| 6,421,516 | B1 * | 7/2002 | Kinoshita et al. | 399/254 |
| 6,882,816 | B2 * | 4/2005 | Tamai | 399/254 |
| 7,006,784 | B2 * | 2/2006 | Ikeda et al. | 399/254 X |
| 7,228,093 | B2 * | 6/2007 | Sakai et al. | 399/254 |
| 7,289,754 | B2 * | 10/2007 | Miyasaka et al. | 399/256 X |
| 7,369,796 | B2 * | 5/2008 | Amano et al. | 399/254 |
| 2005/0254860 | A1 | 11/2005 | Kimura et al. | |
| 2008/0085136 | A1 | 4/2008 | Kimura et al. | |

FOREIGN PATENT DOCUMENTS

| | | |
|---|---|---|
| JP | 05-333700 | 12/1993 |
| JP | 10-319721 | 12/1998 |
| JP | 2005-316160 | 11/2005 |
| JP | 2005-326637 A | 11/2005 |

* cited by examiner

*Primary Examiner*—Sandra L Brase
(74) *Attorney, Agent, or Firm*—Nixon & Vanderhye, P.C.

(57) ABSTRACT

The developing apparatus includes a developing container in which a developer containing a toner and a carrier is stored, a developing roller which carries the developer, and agitating transporting members which circulate and transport the developer along a rotary axis line of a developing roller while mixing and agitating the developer. The developer container includes a developing zone portion corresponding to the developing roller and an extended zone portion which is provided adjacent to the developing zone portion in an axial direction of the developing roller. The developer container is provided with a developer blocking member which separates the developing zone portion and the extended zone portion. The developer container is provided with valves which open in a developer transporting direction in a communicating portion of the developer blocking member between the developing zone portion and the extended zone portion.

9 Claims, 5 Drawing Sheets

103
102
1
105
104
10
S
N
N
S
N
112
P
113
111
116
117

DEVELOPING APPARATUS AND IMAGE FORMING APPARATUS PROVIDED WITH THE SAME

CROSS-REFERENCE TO RELATED APPLICATION

This application claims priority to Japanese Patent Application No. JP 2005-362381, which was filed on Dec. 15, 2005, the contents of which, are incorporated herein by reference, in their entirety.

BACKGROUND OF THE INVENTION

1. Field of the Invention

The present invention relates to a developing apparatus for an electrophotographic system, and more particularly to a developing apparatus and an image forming apparatus employing the same for developing an electrostatic latent image formed on an image bearing member by means of a developer containing a toner and a carrier in a so-called electrophotographic image forming apparatus such as an electrostatic copying machine, or a laser beam printer or the like.

2. Description of the Related Art

Conventionally, in copying machines or printers, development is performed by supplying a toner from a developing apparatus to an electrostatic latent image which is formed on a photoreceptor as an image bearing member. As the foregoing developing apparatus there is typically known a developing apparatus for a one-component development system using only a toner as a developer, and a developing apparatus for a two-component development system using a developer containing a toner and a carrier.

As an example of a developing apparatus for a two-component development system using a developer containing a toner and a carrier, a developing apparatus as shown in FIGS. 7 and 8 is used.

Referring briefly to the developing apparatus 100, in a developer container 101 in which a developer 2 containing a toner and a carrier is stored internally, provided are a developing roller 110 which faces a photoreceptor drum 1 as an image bearing member, and first and second agitating transporting members 150 and 160 which agitate and transport a developer parallel to each other on a side opposite to a side in which the developing roller 110 faces the photoreceptor drum 1.

The developing roller 110 comprises a developing sleeve 110*a* which is composed of a nonmagnetic member in a cylindrical shape and is rotationally driven, and a magnetic member 110*b* which is provided in the developing sleeve 110*a* and includes a plurality of magnetic poles N and S. A developer is magnetically attracted by magnetic force of magnetic member 110*b* to the surface of the developing sleeve 110*a* constituting the developing roller 110. The rotation of the developing sleeve 110*a* in a direction of an arrow transports a developer which is attracted to the developing sleeve 110*a*, to a developing zone facing the photoreceptor drum 1, and transports the developer into the developer container 101 after development. A developer 2 is formed in a shape of a magnetic brush at a magnetic pole N part of the magnetic member 110*b*. Such a brush structure part rubs on the surface of the photoreceptor drum 1 to develop an electrostatic latent image formed on the photoreceptor drum 1 by a toner.

The developer which is transported to a developing position facing the photoreceptor drum 1 by the rotation of the developing sleeve 110*a* is regulated to the predetermined amount in the middle of the transportation by a regulating member 170 which is provided so that its tip end faces the surface of the developing sleeve 110*a*. That is, the regulating member 170 is provided in order to supply a substantially fixed amount of the developer which is transported to the developing zone facing the photoreceptor drum 1.

In the developing container 101, a partition wall 120 is disposed in an erected manner so as to partition a zone in which the first and second agitating transporting members 150 and 160 are arranged, into first and second developer transporting portion zones 130 and 140. The first and second agitating transporting members 150 and 160 which are rotationally driven are provided in the zones 130 and 140 respectively.

The first and second agitating transporting members 150 and 160 comprises rotary shafts 150*a* and 160*a*, and a plurality of blade members 150*b* and 160*b* which are elliptically formed, respectively, and the blade members 150*b* and 160*b* are arranged at intervals so as to be tilted to the rotary shafts 150*a* and 160*a*, respectively. The partition wall 120 has openings 120*a* and 120*b* which are formed by cutting off both ends thereof, as shown in FIG. 8. A developer is passed in directions of arrows at the openings 120*a* and 120*b*. For that purpose, in accordance with the openings 120*a* and 120*b*, one ends of the first and second agitating transporting members 150 and 160 are each provided with blade members 150*c* and 160*c* which are tilted in a direction opposite to those of the blade members 150*b* and 160*b*, in order to supply the developer 2 in directions of arrows.

In the developing apparatus 100 described above, the rotation of the first and second agitating transporting members 150 and 160 which are provided in the first and second developer transporting zones 130 and 140 respectively transports the developer 2 in the first developer transporting zone 130 and the second developer transporting zone 140 in directions opposed to each other, while the developer 2 containing a toner and a carrier is mixed by the blade members 150*b* and 160*b* which provided in the agitating transporting members 150 and 160 respectively. At this time, in the zones of the both ends the developer 2 is passed between the first developer transporting zone 130 and the second developer transporting zone 140 through the openings 120*a* and 120*b* at the both ends of the partition wall 120. The developer 2 is then circulated in the zones 130 and 140. During this circulation, the developer 2 is supplied to the developing roller 110 which is arranged facing the first developer transporting zone 130 in the first developer transporting zone 130.

Consequently, when the developing sleeve 110*a* is rotated, as described above, the developer 2 which is attracted to the developing sleeve 110*a* is transported and the amount thereof is regulated by the regulating member 170 in the middle of the transportation, and the developer is supplied into the developing zone 180 facing the photoreceptor drum 1. The electrostatic latent image formed on the photoreceptor drum 1 is developed by the toner in the developer 2. As described above, a toner in the developer 2 is consumed through development to be gradually decreased in a toner concentration of the developer 2. Therefore, a toner concentration sensor for detecting the toner concentration or the like is provided. When the toner concentration of the developer 2 drops blow the predetermined concentration, this fact is detected by the toner concentration sensor and additional toners are replenished to the developer 2 based on the detection.

Japanese Unexamined Patent Publication JP-A 10-319721 (1998) discloses, as means for achieving a good mixture of a toner with a carrier, an image developing apparatus having a structure in which a developer is circulated by two screws which are arranged in parallel and whose transporting direction is opposed to each other, and the circulating developer is replenished with a toner to mix the carrier of the developer and the toner. The developing apparatus provides at least one screw of the screws which is provided with a circulation portion for circulating the carrier, and a projection portion which is replenished with the toner and transports the toner toward the circulation portion. The replenished toner is transported toward the circulation portion by the projection portion to be mixed with the carrier of the developer in the circulation portion. At this time, it is disclosed that since the toner which is transported by the projection portion is supplied into lower part of the developer which is circulated, it becomes possible to achieve a good mixture of the toner with the carrier of the developer.

According to the invention disclosed in the JP-A 10-319721, since the toner is replenished directly to the developer which is circulated after development, when the insufficient agitation of the toner in the toner replenishment occurs, the developer is supplied from the agitating transporting portion to the developing sleeve with the toner insufficiently charged. Therefore, such problems are concerned that a fog in an image by the insufficiently charged toner occurs, and contamination in the image forming apparatus by a toner scattered from the developing apparatus occurs.

Additionally, according to the JP-A 10-319721, a toner is directly transported and supplied to a developing portion. Therefore, sufficient mixture of toner is not expected, resulting in unevenness of a toner concentration. As a result, it is expected that unevenness of an image concentration and the like occur.

BRIEF SUMMARY

An example embodiment provides a developing apparatus in which in a magnetic brush developing system, when a toner is newly replenished into a developer, the toner which is replenished is promptly and uniformly distributed into a developer in an apparatus body to be sufficiently mixed, agitated, and thus used for development with the toner adequately charged, and an image forming apparatus employing the same.

To solving the problem, the example embodiment provides an developing apparatus comprising:

an developing container in which a developer containing a toner and a carrier is stored;

a developer bearing member for bearing the developer; and an agitating transporting mechanism for circulating and transporting the developer along a direction of a rotary axis line of the developer bearing member while mixing and agitating the developer, wherein the developing container includes a developing zone portion corresponding to the developer bearing member, and an extended zone portion which is provided adjacent to the developing zone portion in an axis direction of the developer bearing member, provides a developer blocking member for separating the developing zone portion and the extended zone portion, and provides a valve for opening in a developer transporting direction in a communicating portion of the developer blocking member in which the developing zone portion is in communication with the extended zone portion.

The configuration as described above allows a toner which is replenished to be promptly distributed and supplied into the whole of a developer in a developing apparatus body, thus preventing a toner concentration of a developer from partially becoming excessively high. In addition, this allows a toner which is replenished to be sufficiently mixed and agitated so as to be adequately charged, thus preventing a fog in an image by a toner which is insufficiently charged, and contamination in an image forming apparatus by a toner scattered from a developing apparatus.

It is preferable that the agitating transporting mechanism is provided in the developing zone portion and the extended zone portion which are separated by the developer blocking member and the valve so as to agitate and transport the developer of each zone portion.

It is preferable that the agitating transporting mechanism includes an agitating transporting member which is integrally provided so as to extend from the developing zone portion to the extended zone portion.

It is preferable that the agitating transporting mechanism includes two agitating transporting members configured so that the developer transporting directions are directed opposite to each other in order to circulate and transport the developer, is provided with partition walls between the two agitating transporting members in the developing zone portion and the extended zone portion, respectively, and circulates and transports the developer while biasing the developer toward a wall opposite to the partition wall by each of the agitating transporting members.

It is preferable that a toner replenishment portion is provided corresponding to the extended zone portion of the developer container.

It is preferable that the extended zone portion is provided on a downstream side in a developer transporting direction of the agitating transporting member facing the developer bearing member.

It is preferable that the agitating transporting member includes a rotary shaft which is provided with an agitating member having a spiral screw form.

It is preferable that the developer blocking member is configured so that one end thereof is located inside a circumference part of one of the agitating transporting members and another end thereof is located inside a circumference part of another of the agitating transporting members.

The technoiogy provides an image forming apparatus comprising the developing apparatus as described above.

BRIEF DESCRIPTION OF THE DRAWINGS

Other and further objects, features, and advantages will be more explicit from the following detailed description taken with reference to the drawings wherein.

DETAILED DESCRIPTION

Figure 1:
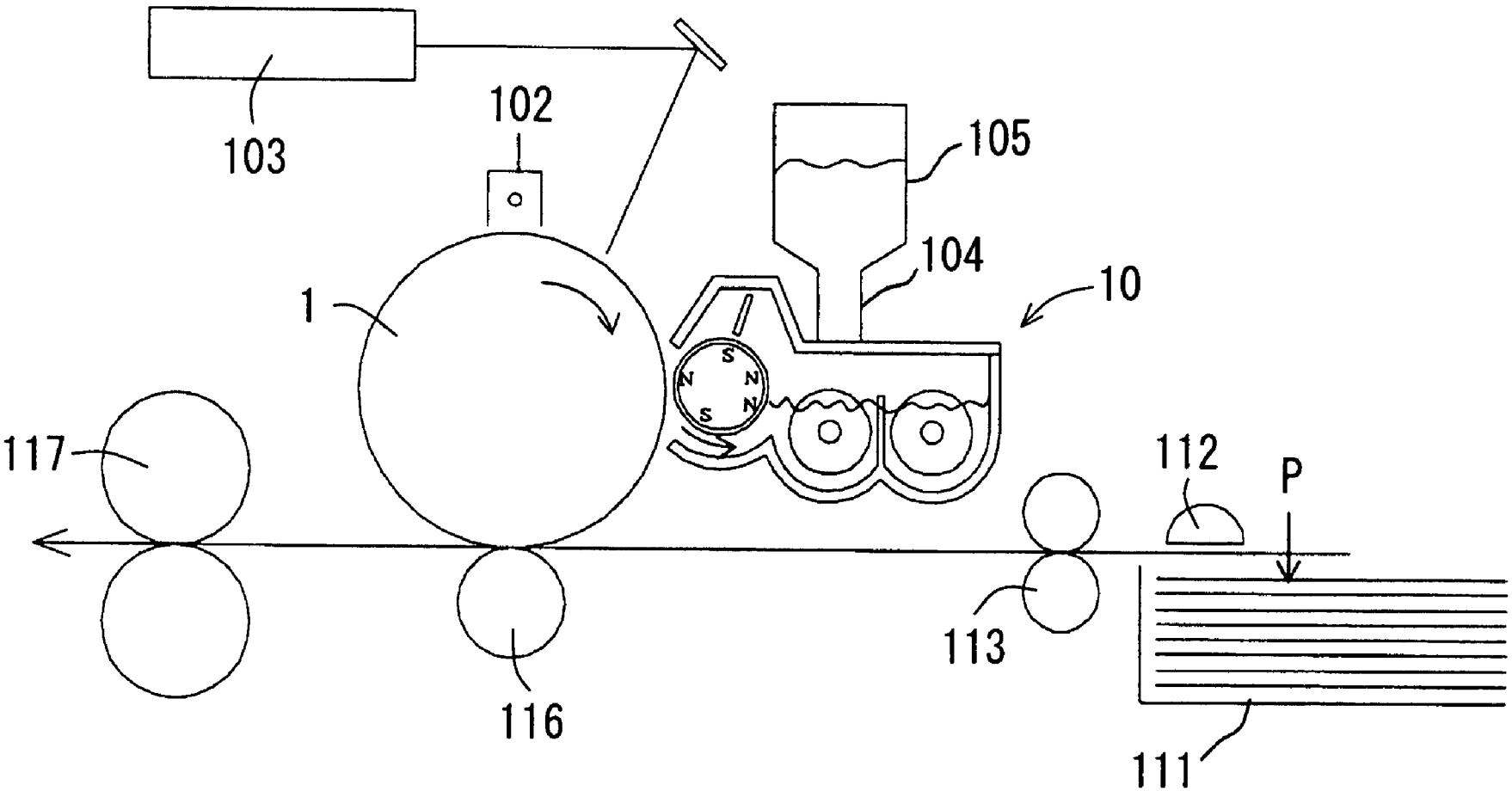
FIG. 1 is a configuration view illustrating one example of an image forming apparatus to which a developing apparatus of an example embodiment is adapted.

Now referring to the drawings, preferred embodiments of the disclosed technology are described below.

Developing apparatus according to example embodiments will be described with reference to the drawings below. It is understood that the present embodiments are to be considered as illustrative and the technical scope thereof is not restrictive.

FIG. 1 shows a schematic configuration of an image forming apparatus employing a developing apparatus according to an example embodiment. The image forming apparatus as shown in FIG. 1 illustrates an example in which an electrophotographic image forming process forms an image on a sheet which is a recording medium by means of a toner. The invention is applicable but not limited to any image forming apparatus which forms an electrostatic latent image on an image bearing member by employing, for example, an electrophotographic system and an electrostatic recording system and then develops the electrostatic latent image by a two-component developer.

First, an electrophotographic image forming apparatus as shown in FIG. 1 includes a cylindrical electrophotographic photoreceptor as an image bearing member, that is, a photoreceptor drum 1. The photoreceptor drum 1 is rotated in a direction of an arrow to form an electrostatic latent image thereon by latent image forming means. That is, a surface of the photoreceptor drum 1 is charged to a specified level of potential by a charger 102 which is a charging apparatus. The surface of the photoreceptor drum 1 which is charged subjects to an exposing treatment by exposure means 103. For example, the exposure means 103 emits a light image from a semiconductor laser which is controlled depending upon image information to perform an exposing treatment on the surface of the photoreceptor 1. The latent forming means constitutes the charger 102 and the exposure means 103.

The exposing treatment forms an electrostatic latent image on the surface of the photoreceptor drum 1 in accordance with image information. The electrostatic latent image which is formed on the surface of the photoreceptor drum 1 is then visualized (developed) by the developing apparatus 10 of this embodiment to form a toner image. The toner image which is formed on the photoreceptor drum 1 is transferred onto a sheet P which is transported at a predetermined timing by paper feeding means (recording medium transporting means) which is constituted by a paper cassette 111, a paper feeding roller 112 and a pair of registration roller 113.

A transfer roller 116 as transfer means is provided facing the photoreceptor drum 1 in a position in which a toner image is transferred. The sheet P which is stored in the paper cassette 111 via the paper-feeding means as described above is transported at a predetermined timing to a transfer portion between the transfer roller 116 and the photoreceptor drum 1. This allows a toner image formed on the surface of the photoreceptor drum 1 to be transferred onto the sheet P by an operation of the transfer roller 116.

Subsequently, the sheet P as described above is separated from the photoreceptor drum 1 and then transported to a fixing apparatus 117. For example, the fixing apparatus 117 comprises a heating roller which is heated and controlled to a predetermined temperature in order to fuse a toner and fix the toner onto the sheet P, and a pressure roller which is contact-pressed against the heating roller, for pressing the toner image against the sheet P onto the heating roller. by the fixing apparatus 117, the toner image which is not fixed onto a recording medium is fixed on the recording medium by means of heat and pressure, and then the toner image which is fixed is discharged out of the image forming apparatus.

In addition, a toner replenishment apparatus 105 for replenishing a toner to the developing apparatus 10 is provided adjacent to the developing apparatus 10. As will hereinafter be described in detail, the toner replenishment apparatus 105 is configured so as to be in communication with a developer container 9 in which a developer is stored via a toner replenishment port 104 which is provided in the developer container 9 in the developer apparatus 10, in order to replenish a toner to the developer apparatus 10 according to a predetermined operation.

Figure 2:
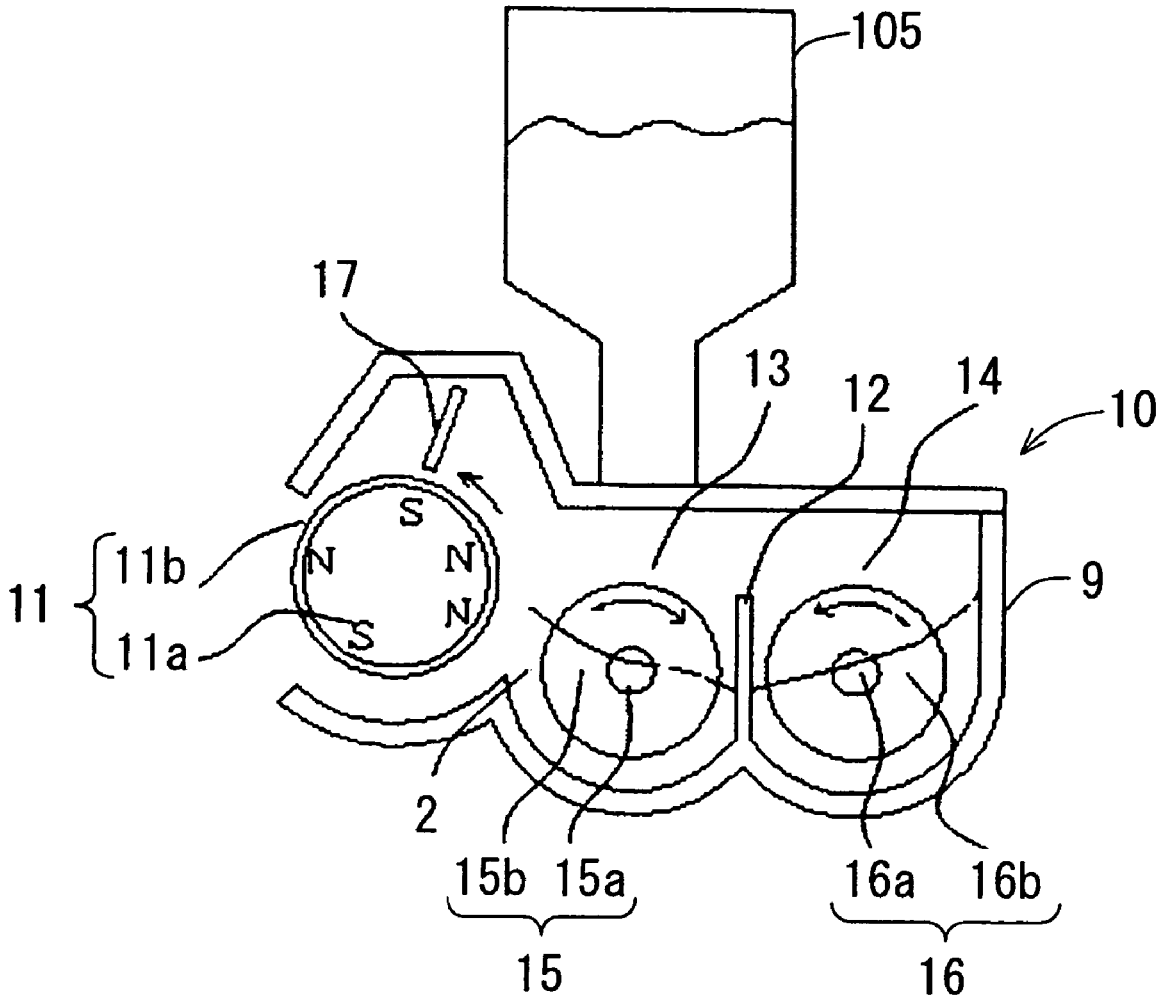
FIG. 2 is a cross sectional configuration view of the developing apparatus of an example embodiment.

FIG. 2 shows a schematic configuration view of the developing device 10 according to one example embodiment. The developing device 10 according to one example embodiment is a two-component contact developing apparatus (a two-component magnetic brush developing apparatus). That is, the developing apparatus 10 stores a developer 2 containing a toner and a carrier in the developer container 9 as a developer storing portion. A developing roller 11 as a developer bearing member which is rotatable in a direction of an arrow in FIG. 2 is provided in an opening facing the photoreceptor drum 1 in the developer container 9. The developing roller 11 includes a developing sleeve 11*a* which is composed of a cylindrical nonmagnetic member which is rotationally driven. The developing sleeve 11*a* includes therein a fixing magnetic roller 11*b* as magnetic field generating means which fixing magnetic roller has a plurality of magnetic poles, allowing a carrier carrying a toner to be magnetically attracted to the developing sleeve 11*a* and to be held thereon by means of magnetic force generated by the fixing magnetic roller 11*b*.

A doctor blade 17 as developer layer thickness regulating means is arranged facing the developing sleeve 11*a* at a predetermined distance. The doctor blade 17 regulates a thickness (or an amount) of a developer which is attracted to the developer sleeve 11*a* and is transported thereon, whereby forming a thin layer of the developer, in association with the rotation of the developing sleeve 11*a* in a direction of an arrow. The developing sleeve 11*a* is arranged so as to keep a predetermined distance from the photoreceptor drum 1 in a state in which after the doctor blade 17 forms a layer of a developer on the developing sleeve 11*a*, the developer contacts the photoreceptor drum 1. In particular, on the developing sleeve 11*a* which faces the photoreceptor drum 1, the developer forms a magnetic brush at a magnetic pole N of the fixing magnetic roller 11*b* which is included in the developing sleeve 11*a*. The magnetic brush of the developer is rubbed against the surface of the photoreceptor drum 1, whereby transferring a toner to an electrostatic latent image to form a toner image.

Subsequently, in association with the rotation of the developing sleeve 11*a*, the developer is returned into the developer container 9 and stripped from the developing sleeve 11*a* by the magnetic repulsion between N poles, as shown in FIG. 2, of the fixing magnetic roller 11*b* to be mixed with a developer in the developing container 9. A new developer is then transported to the developer thickness regulating portion having the doctor blade 17 to form a thin layer on the developing sleeve 11*a*, then contributing to development.

To supply a developer to the developing sleeve 11*a*, first and second agitating transporting members 15 and 16 which constitute two agitating means arranged parallel to a rotary axis line of the developing sleeve 11*a* are provided parallel to each other in the developing container 9, on a back side of the developer sleeve 11*a*, that is, on a side opposite to the side facing the photoreceptor drum 1. That is, the first and second agitating transporting members 15 and 16 constitute a agitating transporting mechanism. In the developer container 9, a partition wall 12 is arranged in an erect manner from a bottom of the container so as to partition an internal space of the developer container 9. The partition wall 12 partitions the developer container 9 to provide first and second developer transporting zones 13 and 14 for circulating and transporting a developer. The first and second agitating transporting members 15 and 16 are provided in the partitioned zones 13 and 14 respectively.

Figure 3:
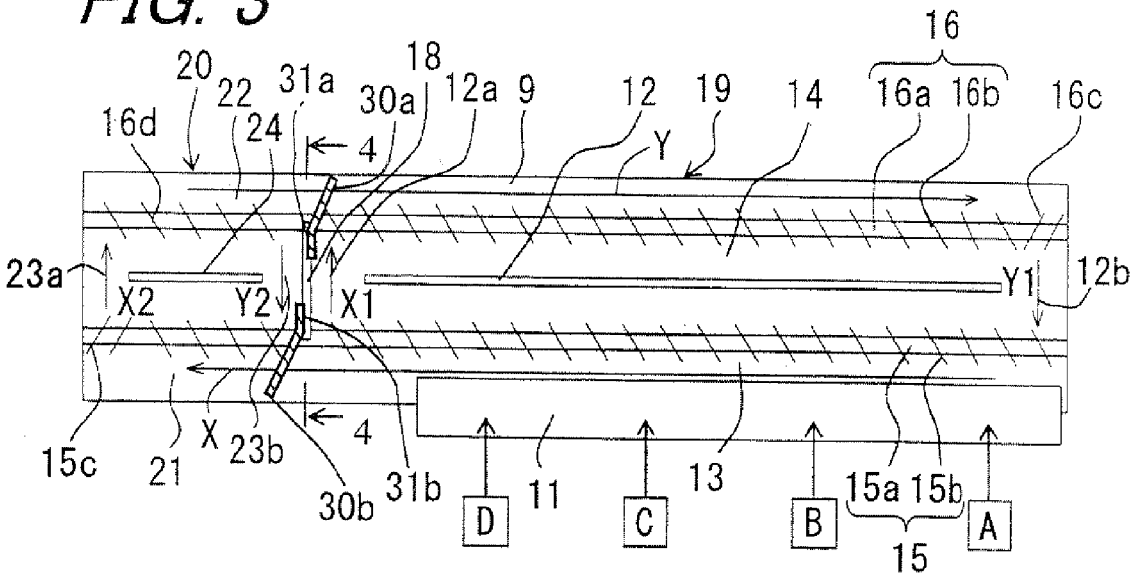
FIG. 3 is a plan configuration view of the developing apparatus of an example embodiment.

The first and second agitating transporting members 15 and 16 have substantially a same configuration, and as shown in FIG. 3, includes rotary shafts 15*a* and 16*a* and a plurality of blade members 15*b* and 16*b* which are elliptically formed, respectively, and the blade members 15*b*, 16*b* are arranged at intervals so as to be tilted to the rotary shafts 15*a* and 16*a*. Alternatively, a spiral screw configuration may be adapted in place of the blade members 15*b* and 16*b*. It will be understood that other members having a structure which mixes, agitates and transports a developer may be provided beyond these examples.

The developer container 9 of this embodiment, as shown in FIG. 3, provides an extended zone portion 20 whose one end side is farther extended along the rotary axis line of the first and second agitating members 15 and 16, in addition to the developing zone portion 19 which is a portion facing the developing roller 11. The extended zone portion 20 is an agitating zone which is provided for playing a role in mixing a toner which is replenished with a developer and agitating the mixture.

The developer container 9 integrally having the developing zone portion 19 and the extended zone portion 20, provides first and second extended transporting zones 21 and 22 which are each in communication with the first and second developer transporting zone 13 and 14 also on the extended zone portion 20 side. To separate the zones 21 and 22, a partition wall 24 is arranged in an erect manner from a bottom of the developer container 9 as in the case of the partition wall 12.

As shown in FIG. 3, the first and second agitating transporting members 15 and 16 is provided to extend in the developer container 9 having the first and second extended transporting zones 21 and 22. That is, the first and second agitating transporting members 15 and 16 which are integrally formed are arranged over a zone from the first and second developer transporting zones 13 and 14 to the first and second extended transporting zones 21 and 22 which are each in communication with the first and second developer transporting zones 13 and 14.

In addition, the developer container 9 provides a developer blocking board 18 between the developing zone portion 19 and the extended zone portion 20 in a direction perpendicular to the partition walls 12 and 24, that is, in a direction perpendicular to the rotary axis line. The developer blocking board 18 is provided for separating the developing zone 19 which faces the developing sleeve 11*a* and performs development by the developing sleeve 11*a*, from the extended zone portion 20, and for regulating a part of a developer which is transported. Accordingly, the developer blocking board 18 blocks in a side in which the first and second agitating transporting members face each other, and opens in a side in which the first and second agitating transporting members 15 and 16 each face side walls of the developer container 9. Therefore, between the developing zone portion 19 and the extended zone portion 20, via an opening portion, the first developer transporting zone 13 is in communication with the first extended transporting zone 21 and the second developer transporting zone 14 is in communication with the second extended transporting zone 22.

And the developer blocking board 18 provides a valve 30 which opens and closes in a developer transporting direction. The valve 30 includes a valve 30*b* which is provided at an opening portion between the first developer transporting zone 13 and the first extended transporting zone 21, and a valve 30*a* which is provided at an opening portion between the second developer transporting zone 14 and the first extended transporting zone 22. The valve 30*b* is a one-way valve which opens when a developer is transported from the developing zone portion 19 to the extended zone portion 20, and which closes when a developer is transported in a direction opposite thereto. The valve 30*a* is a one-way valve which opens when a developer is transported from the extended zone portion 20 to the developing zone portion 19, and which closes when a developer is transported in a direction opposite thereto. Therefore, each of the valves 30*a* and 30*b* is provided so as to be opened when constant pressure caused by a developer which is transported is applied to each of valves, and whereby allowing transportation of the developer between the zones.

Additionally, the valves 30*a* and 30*b* are formed of, for example, a PET (polyethylene terephthalate) film, and one ends thereof are each attached and fixed onto the developer blocking board 18 by a two-sided tape. In particular, referring to FIG. 3, one end of the valve 30*b* is fixed onto the developer blocking board 18 facing the extended zone portion 20 side, and one end of the valve 30*a* is fixed onto the developer blocking board 18 facing the developing zone portion 19 side.

In addition, the member of the valves 30*a* and 30*b* may be not limited to the PET film, and a member of rubber or the like may be employed. And as described above, the structure thereof may be adapted to open in a developer transporting direction.

The partition wall 12 is provided so as to separate the first and second developer transporting zones 13 and 14 in which the first and second agitating transporting members 15 and 16 are arranged. The partition wall 12 is provided for blocking a developer from directly passing to the first and second developer transporting zones 13 and 14. The partition wall 12 is configured so that portions thereof corresponding to both ends of the developing zone portion 19 in a developer transporting direction in the developing zone portion 19 facing the developer roller 11 are cut off. That is, a longitudinal length of the partition wall 12 is shorter than that of the developing zone portion 19. In this manner, openings 12*a* and 12*b* are formed between the developer container 9 and the partition wall 12.

Moreover, as described above, the extended zone portion 20 provides a second partition wall 24 which plays the same role as the partition wall 12 between the first and second agitating transporting members 15 and 16 in the developer container 9. The second partition wall 24 is provided for blocking a developer from directly passing to the first and second extended transporting zones 21 and 22. Both ends of the second partition wall 24 are cut off. That is, a longitudinal length of the partition wall 24 is shorter than that of the extended zone portion 20. In this manner, the cut-off portions provide openings 23*a* and 23*b* which allow the developer to pass therethrough.

As described above, since each of the partition walls 12 and 24, the developer blocking board 18 and the valves 30*a* and 30*b* are provided in the developer container 9, by the rotation of the first and second agitating transporting members 15 and 16, a developer is circulated and transported between the developer transporting zones 13 and 14 in the developing zone portion 19 and between the extended transporting zones 21 and 22 in the extended zone portion 20 respectively. The operation will be described below, referring to FIG. 3.

First, in the first developer transporting zone 13, by the rotation of the first agitating transporting member 15, a developer 2 is agitated and transported in a direction of an arrow X. The developer which is partially blocked by a portion of the developer blocking board 18 and valve 30*b* is then transported through the opening 12*a* in an X1 direction to the second agitating transporting member 16 side of the second developer transporting zone 14. And a portion of the developer which is not regulated is blocked at a position of the valve 30*b*. When the developer which is blocked gradually increases in an amount and a pressure applying to the valve 30*b* exceeds a fixed pressure level, the valve 30*b* is opened, allowing the developer to be transported in an X direction into the first extended transporting zone 21 of the extended zone portion 20.

Next, the developer which is transported into the second developer transporting zone 14 is agitated and transported in a Y direction by the rotation (in a opposite direction to the rotation of the first agitating transporting member 15) of the second agitating transporting member 16. The developer which is transported in a Y direction is transported in a Y1 direction through the opening 12*b* of the partition wall 12 at one side end of the developer container 9, into the first developer transporting zone 13 of the first agitating transporting member 15 side. The repeated operations allow a developer to be agitated and transported in the developing zone portion 19 of the developer container 9.

On the other hand, the developer which is transported into the first extended transporting zone 21 via the valve 30*b* is transported in an X direction through the opening 23*a* at another side end of the developer container 9, and is then transported in an X2 direction into the second extended transporting zone 22 of the second agitating transporting member 16 side. The developer is then transported in a Y direction by the second agitating transporting member 16, and then partially blocked by the developer blocking board 18 and the valve 30*a*. The developer is then returned to the first agitating transporting member 15 side in a Y2 direction through the opening 23*b* which is provided corresponding to a position in which the developer is blocked. Accordingly, the developer 2 is circulated and transported so as to follow the path described above in the extended zone portion 20. As described with respect to the valve 30*a*, when a pressure of a developer exceeds the fixed pressure level, the valve 30*a* is opened, allowing the developer to be transported into the developing zone portion 19.

At this time, a toner is replenished from the toner replenishment apparatus 105 as described above at the extended zone portion 20 as described above. In particular, the toner replenishment port 104 of the toner replenishment apparatus 105 is arranged facing the first extended transporting zone 21 side of the extended zone portion 20. The toner replenishment apparatus 105 applies a well-known configuration, and operates in response to the detection of a lower toner concentration by a toner concentration sensor. For example, a replenishing roller and the like are rotationally driven in a suitable manner, and a toner which is stored in the toner replenishment apparatus 105 is replenished into the developer 2 in the first extended transporting zone 21 via the toner replenishment port 104 to be mixed and agitated.

As described above, the operation of the valve 30 and a flow of a developer in the case of the toner replenishment will be described. When the detection of a lower toner concentration by the toner concentration sensor (not shown), the replenishment of a toner from the toner replenishment apparatus 105 is performed. When a toner is replenished from the toner replenishment apparatus 105 to the extended zone portion 20, the developer is increased in volume by the circulation, transportation and mixture as described above, and the level of the developer becomes higher than that of the developing zone portion 19 side. The valve 30*a* is opened by the pressure at this time so that the developer 2 is transferred to the developing zone portion 19. When the level of the developer existing in the extended zone portion 20 becomes the same as that of the developer existing in the developing zone portion 19, the valve 30*a* is closed.

Meanwhile, in the developing zone portion 19, as described above, a developer which is transported increases in volume at a position of the valve 30*b*. Hereby, the level of the developer becomes higher than that of the extended zone portion 20 side. The valve 30*b* is opened by the pressure at this time so that the developer is transferred to the extended zone portion 20. When the level of the developer existing in the extended zone portion 20 becomes the same as that of the developer existing in the developing zone portion 19, the valve 30*b* is closed.

As described above, the establishment of the valve 30 allows a developer to be efficiently transported into each of the zone portions 19 and 20. This operation allows circulation of a developer at each zone and transportation of a developer between the zones to be controlled to perform efficient mixture and agitation of a toner with an appropriate amount of a developer. That is, when a toner is replenished, the toner is mixed with a developer which is transported from the developing zone portion 19 to the extended zone portion 20, and is agitated, circulated, and transported. The toner is then transported into the developing zone portion 19 side via the valve 30*a* after the sufficient agitation and mixture. As a result, the developer which is agitated and mixed in the developing zone portion 19 side is transported to the developing roller 11 to perform the development using the toner which is sufficiently charged. Therefore, the establishment of the valves 30*a* and 30*b* permits the efficient mixture and agitation with an appropriate amount of a developer maintained.

In addition, in the openings 12*b* and 23*a* of the partition wall 12 and the second partition wall 24 on each side end of the developer container, in order to efficiently transport a developer into the opposing agitating transporting member 16 or 15 side, as described in FIG. 3, blade members 15*c* and 16*c* of the first developer agitating transporting member 15 and 16 which face the openings 12*b* and 23*a* each have such a configuration that a blade shape thereof is different from those of the other blade members and a direction of tilt thereof is opposite to those of the other blade members. In addition, the similar configuration may be adapted also in a case of a spiral screw configuration in place of the blade member. As described in FIG. 3, in the first and second agitating transporting members 15 and 16, the blade members 15*b* and 16*b* as an agitating member are not provided at positions facing the developer blocking board 18 so that the valves 30*a* and 30*b* as described above can operate without being disturbed by the blade members 15*b* and 16*b*.

Figure 4:
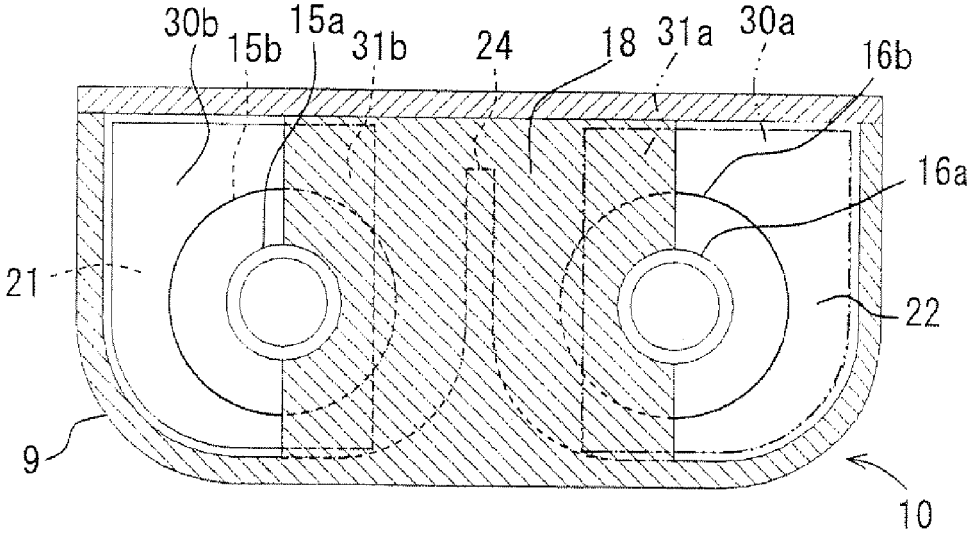
FIG. 4 is a cross sectional view illustrating one example of the configuration of a developer blocking board structure taken on line 4-4 in FIG. 3.

The configuration of the developer blocking board 18 and the valves 30*a* and 30*b* is described above. One example of the configuration is shown in FIG. 4. FIG. 4 is a cross sectional view taken on line A-A in FIG. 3. The developer blocking board 18 is provided so as to block about a half of each of portions where plan shapes of the blade members 15*b* and 16*b* of the first and second agitating transporting members 15 and 16 form a circle. That is, the developer blocking board 18 is provided so as to block about a half of each of the blade members 15*b* and 16*b* at a position in which the first and second agitating transporting members 15 and 16 which are adjacent to each other face each other. The valves 30*a* and 30*b* are provided in end zones 31*a* and 31*b* of the developer blocking board 18.

The developer blocking board 18 cuts off portions facing the rotary shafts 15*a* and 16*a*, and is provided so as to make both ends of the developer blocking board 18 positioned closer to a shaft center than an projected outside diameter portion of the blade members 15*b* and 16*b*. This forms the opening portions between both ends of the developer blocking board 18 and side walls of the developer container 9 parallel to the developer transporting directions, whereby via the opening portions, the first developing transporting zone 13 and the first extended transporting zone 21 are in communication with each other, and the second developing transporting zone 14 and the second extended transporting zone 22 are in communication with each other. The valves 30*a* and 30*b* are provided so as to block a communicating portion which is opened, and are provided in such a manner that one ends of the valves 30*a* and 30*b*, as described above, are fixed to end zones of the developer blocking board 18 and the other free end sides thereof are located along transporting walls of the developer container 9.

As described above, according to the developing apparatus 10 of an example embodiment, the developing apparatus 9 provides the developing zone portion 19 for circulating and transporting a developer which developing zone portion is arranged facing the developing roller 11, and the extended zone portion 20 for extending a transporting path of the developer outwards from the developing zone portion 19 in a developer transporting direction by the first agitating transporting member 15. The developer blocking board 18 and the valves 30*a* and 30*b* which partially regulate a flow of a developer are provided so as to separate the extended zone portion 20 and the developing zone portion 19, whereby forming the flows of the developer as described above. The developer which is transported then strikes against the developer blocking board 18, and is circulated and transported in the developing zone portion 19 and the extended zone portion 20, and the valve 30 is opened due to the deference of the developer in volume, which is transported into each of the zones 19 and 20. At this time, since the developer which is transported strikes against the developer blocking board 18 and is transported into each of the zones so as to be distributed thereto, a distributing and agitating effect at this time facilitates mixture and agitation of the developer.

Therefore, when a toner is replenished in the extended zone portion 20, the toner which is replenished is mixed with a developer to be efficiently dispersed. The sufficient agitation in the extended zone portion 20 causes a sufficient charge of toner before the toner is transported into the developing zone 19. As a result, the toner is uniformly dispersed in a developer to create a state in which the toner is sufficiently charged, contributing to development. This enables the suitable development with a uniform concentration.

(A Preferred Embodiment of the Extended Zone Portion 20 in the Developer Container 9)

In the developing apparatus 10 as described above, when the extended zone portion 20 sufficiently elongates in the developer transporting direction, the improvement of an agitating effect is expected. However, when the extended zone portion 20 is too elongated in a developer transporting direction, the image forming apparatus comprising the developing apparatus 10 requires a wasted space. On the contrary, when the length of the extended zone portion 20 is too short, the sufficient agitating effect may not be expected.

Consequently, a proportion of the length of the extended zone portion 20 with respect to a total length including the developing zone portion 19 and the extended zone portion 20 should be set to be 15% or more. By the setting as described above, it is expected that a moving and agitating effect caused by the transportation by the first and second agitating transporting members 15 and 16 in the extended zone portion 20 and the distributing and agitating effect caused by the developer blocking board 18. However, when the proportion of a length of the extended zone portion 20 with respect to the total length is less than 15%, the moving and agitating effect caused by the transportation by the first and second agitating transporting members 15 and 16 considerably comes to weak, causing the increase of only the distributing and agitating effect in the developer blocking board 18 portion, which eliminates the synergistic effect with the moving and agitating effect and reduces the uniform dispersion into a developer in the developing apparatus. Therefore, the agitating effect as described above can be sufficiently expected by setting the proportion of the length of the extended zone portion 20 with respect to the total length including the developing zone portion 19 and the extended zone portion 20, to 15% or more. However, when the extended zone portion 20 is elongated, the apparatus requires a wasted space in the image forming apparatus. The proportion of 20% or less may limit a wasted space and efficiently provide the distributing and agitating effect as described above.

(Another Configuration Example of the Developing Apparatus 10)

To improve the transporting and agitating effect, the rotating direction of the first and second agitating transporting members 15 and 16 is set so as to bias the developer 2 toward the outer wall sides of the developer container 9 when the developer is transported. This improves the circulating and mixing effect of a developer. For example, when the first and second agitating transporting members 15 and 16 are rotationally driven in a direction shown in FIG. 2, the developer 2 is biased toward each outer wall side of the developer container 9, whereby increasing and decreasing the developer in volume in the developer blocking board 18 portion brings a sensitive response to the level of the developer, and fine opening and closing operation of the valves 30*a* and 30*b* is achieved.

In addition, an amount of the developer which is filled into the developer container 9 in the developing apparatus 10, referring to FIG. 2 for example, is adapted to hide 50 to 100% of the external diameter portion of the blade members (or screw members) 15*b* and 16*b* in such a state that the first and second agitating transporting members 15 and 16 are not rotationally driven. The reason why such a setting is adopted will be described below.

When an amount of the developer is adapted to hide less than 50% of the external diameter portion of the blade members 15 and 16, the developer 2 is supplied in a faulty manner when supplied from the first agitating member 15 to developing roller 11, causing such a defect in image quality on the developing roller 11 that traces corresponding to a shape of a blade member, which is the agitating member, of the first agitating transporting member 15 or a shape of a screw are left.

When an amount of the developer is adapted to hide more than 100% of the external diameter portion of the blade members 15 and 16, the toner which is replenished has difficulty in being dispersed into the developer 2, and thereby is transported so as to slide on a surface of the developer and a toner which is not agitated is supplied to the developing roller 11. This has caused a defect in image quality, referred to as a fog in an image.

As described above, by filling a developer into the developer container 9 in which the level of the developer is set so as to hide 50% to 100% of the external diameter portion of the blade members 15 and 16, a preferable image quality can be obtained.

In addition, while the partition walls 12 and 24, and the developer blocking board 18 are arranged in an erect manner from a bottom of the developer container 9, a single-piece configuration together with the developer container 9 may be adapted, or the partition walls 12 and 24, and the developer blocking board 18 may be fixed to a bottom of the developer container 9 after the developer container 9 is configured.

Figure 5:
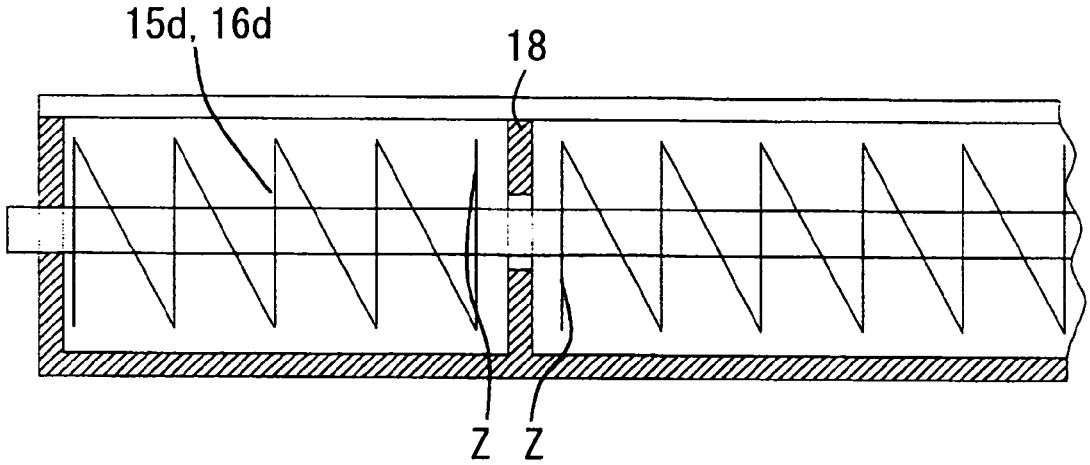
FIG. 5 is a cross sectional view illustrating one example of the configuration of an agitating transporting portion member at a position corresponding to a developer blocking board of an example embodiment.

The configuration of the first and second agitating transporting members 15 and 16 as shown in FIG. 5 provides, as the agitating member, screw members 15*d* and 16*d* which are formed in a spiral shape. The screw members 15*d* and 16*d* are typically provided in succession, but are configured so as to be divided at a position which faces the developer blocking board 18, and in a range Z in which the valves 30*a* and 30*b* operate. Such configuration also provides the same function and effect as the blade members 15*b* and 16*b* as described above.

EXAMPLE

To verify the effect according to the developer apparatus 10 of an example embodiment, an example is described below in which an agitating state and the like in the toner replenishment are obtained by experiments.

Employed was the developer 2 of the example including a negatively-charged toner having an average particle diameter (a weight average particle diameter) of 6.5 μm as a toner, and a magnetic carrier having a saturated magnetization of 70 emu/cm$^3$ and an average particle diameter (a volume average particle diameter) of 45 μm as a carrier.

The developing sleeve 11*a* of the developing roller 11 is a stainless-steel sleeve having an external diameter of 25 mm. To ensure the good transportation of a developer, it is preferable to provide the surface of the developing sleeve 11*a* with adequate asperities, and the surface thereof is blast-treated so that a surface roughness Rz (JIS B 0601: ten-point average roughness) is about 5 to 10 μm.

The developing sleeve 11*a* has a rotating speed of 510 rpm and an axial length of 324 mm.

The valves 30*a* and 30*b* are each formed of a PET film having a thickness of 50 μm, and fixed onto the developer blocking board 18 by a two-sided tape as described in FIG. 3.

The first and second agitating transporting members 15 and 16 were each rotationally driven at a speed of 250 rpm in the direction as shown in FIG. 2, and, in place of the blade members 15*b* and 16*b*, employed the screw configuration having a screw pitch of 25 mm and an projected outside diameter of 20 mm.

In the configuration as described above, an amount of a developer which is filled into the developer container 9 in the developing apparatus 10 is adapted to hide 70% of the projected external diameter of the screw members that is the agitating members. The toner concentration of the developer which is filled is set to 7% by weight.

Moreover, a toner was replenished into the extended transporting zone 21 side of the extended zone portion 20 with such an amount that a toner concentration in the extended zone portion 20 became 9% by weight.

Consequently, the first and second agitating transporting members 15 and 16 were each rotated at the speed as described above to transport the developer 2 in the first and second developer transporting zones 13 and 14 and the first and second extended transporting zones 21 and 22 in order to examine a change in a toner concentration in the developer 2.

To examine a change in a toner concentration of the developer 2, a variation σ in the toner concentration was determined at an "A" point 30 mm away from an end of developing sleeve 11*a* in an uppermost stream side in a developer transporting direction of the first agitating transporting member 15 which supplied the developer 2 to the developing sleeve 11*a* as described in FIG. 3, a "B" point 110 mm away therefrom, a "C" point 190 mm away therefrom, and a "D" point 270 mm away therefrom each, and after 3 seconds, 9 seconds, 15 seconds, 25 seconds, and 30 seconds each.

Figure 6:
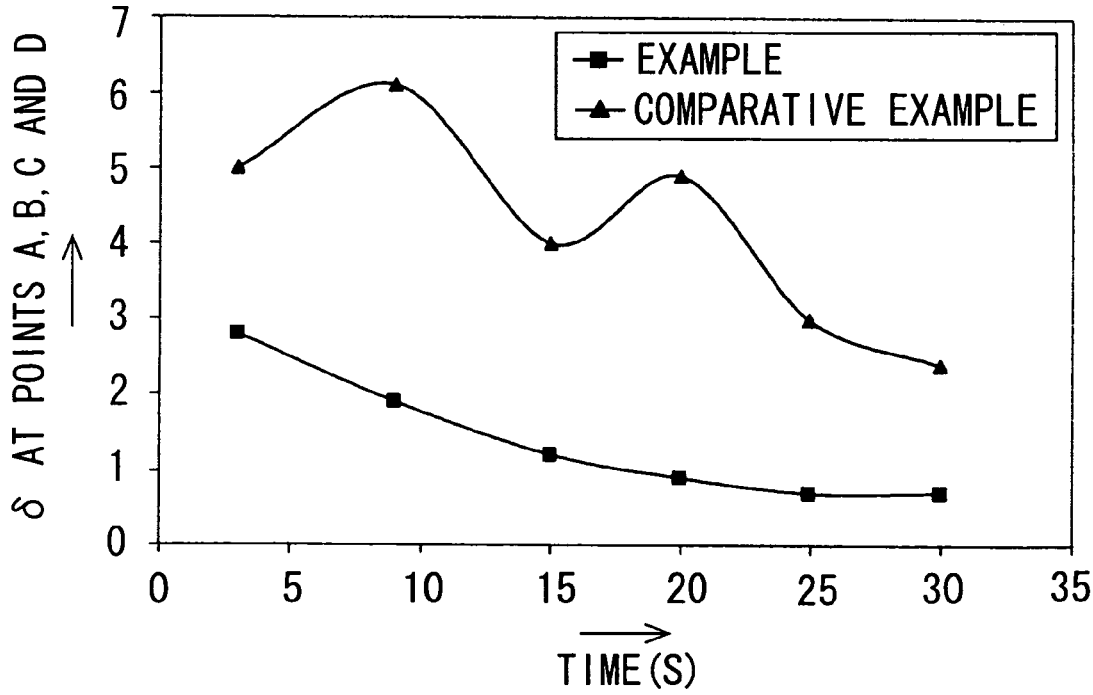
FIG. 6 is a characteristic chart illustrating a relationship between a mixing time of a toner and variations of a toner concentration σ, the relationship showing a mixing state in accordance with the developing apparatuses of an example embodiment and the related art.

At this time, a small and constant variation σ in a short period of time demonstrates the high agitating capability. The result according to the developing apparatus of an example embodiment is shown in FIG. 6.

COMPARATIVE EXAMPLE

Figure 7:
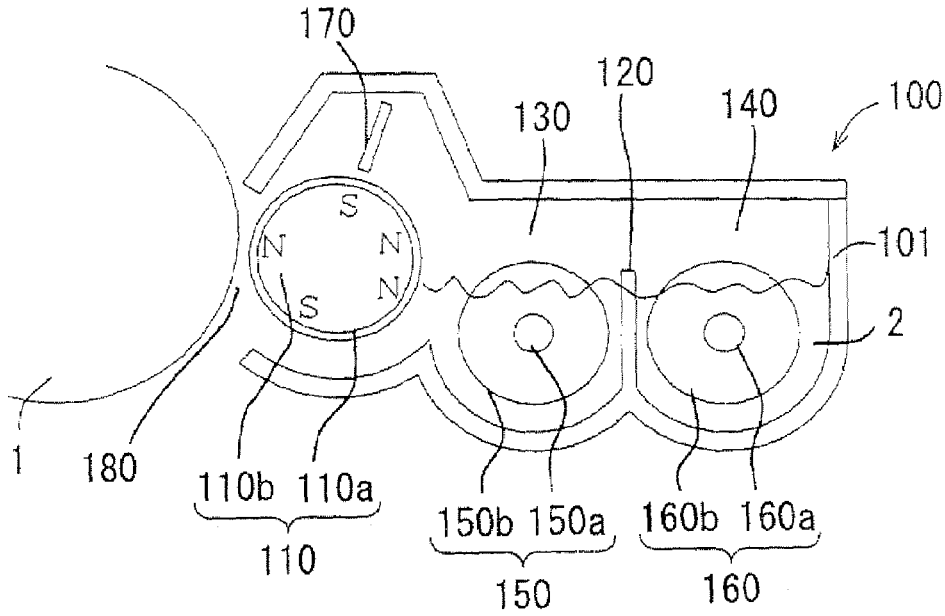
FIG. 7 PRIOR ART
FIG. 7 is a cross sectional configuration view of a developing apparatus according to the related art.
Figure 8:
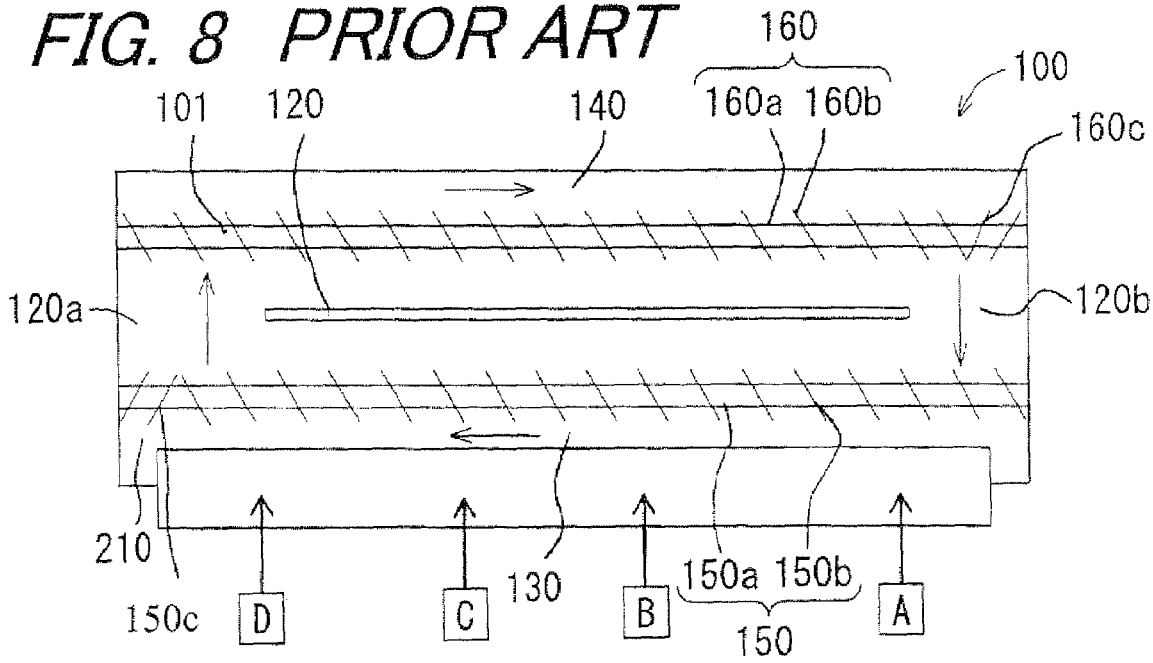
FIG. 8 PRIOR ART
FIG. 8 is a plan configuration view of the developing apparatus according to the related art.

Next, to compare with the developing apparatus of an example embodiment, an experiment was performed using the developing apparatus 100 having a configuration as described as the related art and as described in FIGS. 7 and 8. In this experiment, each configuration of a developer, a developing roller, and in particular a developing sleeve was exactly the same. First and second agitating transporting members and a developer container remained the same except that the extended zone portion 20 of the developing apparatus of the invention did not exist. A toner was replenished in the vicinity of a downmost stream to which the first agitating transporting member 130 transported a developer, in particular at a position corresponding to a portion in which a developer was supplied into the second agitating transporting member.

The measurement points "A" to "B" were also set at the same positions to measure a toner concentration. The result is shown in FIG. 6.

The variation (standard deviation) σ is a value as described in a formula below. That is, the variation σ is obtained by determining a numerical data average, determining a square of a difference between each of pieces of data and the numerical data average with respect to all pieces of data, summing all of the square values, dividing the sum by a number of data and determining a square root of the quotient.

$$\sigma = \sqrt{\frac{1}{N}\sum_{k=1}^{N}(x_k - \bar{x})^2}$$

where N represents the number of data, and $X_k$ represents a data value.

As a result, as shown in FIG. 6, according to the developing apparatus of an example embodiment, a toner which was replenished was promptly and uniformly dispersed into the whole of the developer 2, and a toner concentration increased in a substantially fixed state at "A" to "D" points. On the other hand, according to the conventional developing apparatus having a configuration as shown in FIG. 8, the toner concentration had considerable variations at "A" to "D" points.

Therefore, the developing apparatus 10 of an example embodiment provides a result in which a toner which is replenished shows almost uniform distribution state in the axial direction of the developing roller 11. This demonstrates a good dispersion state of a toner. In addition, mixture and agitation are preferably performed in cooperation with the dispersion, whereby sufficient charge can be expected.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus comprising:

a developing container in which a developer containing a toner and a carrier is stored;

a developer bearing member for bearing the developer; and an agitating transporting mechanism for circulating and transporting the developer along a direction of a rotary axis line of the developer bearing member while mixing and agitating the developer, wherein the developing container includes a developing zone portion corresponding to the developer bearing member, and an extended zone portion which is provided adjacent to the developing zone portion in an axis direction of the developer bearing member, provides a developer blocking member for separating the developing zone portion and the extended zone portion, and provides a valve for opening in a developer transporting direction in a communicating portion of the developer blocking member in which the developing zone portion is in communication with the extended zone portion.

2. The developing apparatus of claim 1, wherein the agitating transporting mechanism is provided in the developing zone portion and the extended zone portion which are separated by the developer blocking member and the valve so as to agitate and transport the developer of each zone portion.

3. The developing apparatus of claim 2, wherein the agitating transporting mechanism includes an agitating transporting member which is integrally provided so as to extend from the developing zone portion to the extended zone portion.

4. The developing apparatus of claim 3, wherein the agitating transporting mechanism includes two agitating transporting members configured so that the developer transporting directions are directed opposite to each other in order to circulate and transport the developer, is provided with partition walls between the two agitating transporting members in the developing zone portion and the extended zone portion, respectively, and circulates and transports the developer while biasing the developer toward a wall opposite to the partition wall by each of the agitating transporting members.

5. The developing apparatus of claim 4, wherein the agitating transporting member includes a rotary shaft which is provided with an agitating member having a spiral screw form.

6. The developing apparatus of claim 4, wherein the developer blocking member is configured so that one end thereof is located inside a circumference part of one of the agitating transporting members and another end thereof is located inside a circumference part of another of the agitating transporting members.

7. The developing apparatus of claim 1, wherein a toner replenishment portion is provided corresponding to the extended zone portion of the developer container.

8. The developing apparatus of claim 1, wherein the extended zone portion is provided on a downstream side in a developer transporting direction of the agitating transporting member facing the developer bearing member.

9. An image forming apparatus comprising the developing apparatus of claim 1.

* * * * *